United States Patent [19]

Budzich

[11] Patent Number: 4,610,194

[45] Date of Patent: Sep. 9, 1986

[54] LOAD SENSING CIRCUIT OF LOAD RESPONSIVE DIRECTION CONTROL VALVE

[75] Inventor: Tadeusz Budzich, Moreland Hills, Ohio

[73] Assignee: Caterpillar Inc., Peoria, Ill.

[21] Appl. No.: 707,351

[22] Filed: Mar. 1, 1985

[51] Int. Cl.[4] ..... F15B 13/02

[52] U.S. Cl. ..... 91/446; 91/421; 137/596.13

[58] Field of Search ..... 91/446, 421; 137/596.13

[56] References Cited

U.S. PATENT DOCUMENTS 3,991,571 11/1976 Johnson ..... 60/422

4,147,034 4/1979 Johnson ..... 60/422

4,362,087 12/1982 Budzich ..... 137/596.13 X

*Primary Examiner*—Gerald A. Michalsky

*Attorney, Agent, or Firm*—J. W. Burrows

[57] ABSTRACT

A load sensing circuit of a load responsive direction control valve including a device for sensing load pressure signals, identifying those load pressure signals as positive or negative and transmitting those identified positive or negative load pressure signals to the throttling compensator controls of the load responsive valve, while also transmitting the positive load pressure signal to the pump control. The identification and distribution of the load pressure signals to the controls of the load responsive circuit can take place with the direction control spool in its neutral position. Therefore such a load pressure sensing and transmitting circuit is capable of anticipating the command signal indicated control function.

28 Claims, 5 Drawing Figures

LOAD SENSING CIRCUIT OF LOAD RESPONSIVE DIRECTION CONTROL VALVE

DESCRIPTION

1. Background of the Invention

This invention relates generally to the load sensing controls of a load responsive system.

In more particular aspects this invention relates to positive and negative load pressure identifying and transmitting controls, for use in load responsive systems.

In still more particular aspects this invention relates to positive and negative load pressure identifying and transmitting controls, which can respond with direction control spool in its neutral position, in anticipation of the system demand.

Load pressure sensing, identifying and transmitting circuits are widely used in control of load responsive systems. Such load pressure sensing, identifying and transmitting circuits usually employ check valve or shuttle valve logic systems, in identification of maximum system load pressure, while various types of load pressure sensing ports, sequentially interconnected by the direction control spool, are used in identification of whether the load pressure signal is positive or negative.

The presence of such load sensing ports, positioned in the bore of a direction control spool, inevitably increases the total spool stroke and dead band of the spool, making the control less sensitive. In order not to increase the dead band of the valve, the flow area of the load pressure sensing ports is selected as small as possible, resulting in substantial attenuation of the signal and greatly affecting the response of the compensating controls. Such load pressure sensing ports are shown in my U.S. Pat. No. 4,154,261, issued May 15, 1979. Since such load pressure sensing ports are gradually uncovered, with the displacement of the direction control spool from its neutral position, at small spool displacements the attenuation of the load pressure signal is very great. This type of load pressure sensing circuit suffers from one additional disadvantage. Since the movement of the direction control spool is directly used in interconnecting the load pressure signal to the compensator or pump controls, it is impossible to transmit such signals with the direction control spool in its neutral position and in anticipation of the control function.

SUMMARY OF THE INVENTION

It is therefore a principal object of this invention to provide a load pressure sensing, identifying and transmitting circuit, capable of transmitting identified load pressure signals to the compensator and pump controls, in anticipation of the displacement of the direction control spool, permitting the throttling controls to assume their throttling control position, before the direction control spool is moved from its neutral position.

It is a further object of this invention to provide a load pressure sensing, identifying and transmitting circuit with minimum attenuation of the load pressure signal.

It is another object of this invention to provide a load signal identifying circuit, in which the direction control spool, with minimal dead band, can be used in a load responsive servo valve with high response characteristics.

It is another object of this invention to provide a load pressure signal identifying circuit, capable of directing positive and negative load pressure signals to the system controls, without utilizing the sequencing action of the direction control spool.

Briefly the foregoing and other additional objects and advantages of this invention are accomplished by providing a novel load pressure sensing, identifying and transmitting circuit with minimum attenuation of the load pressure control signals, while the dead band of the direction control spool is not affected.

Additional object of this invention will become apparent when referring to the preferred embodiment of the invention, as shown in the accompanying drawings and described in the following detailed description.

DESCRIPTION OF THE PREFERRED EMBODIMENTS

Figure 1:
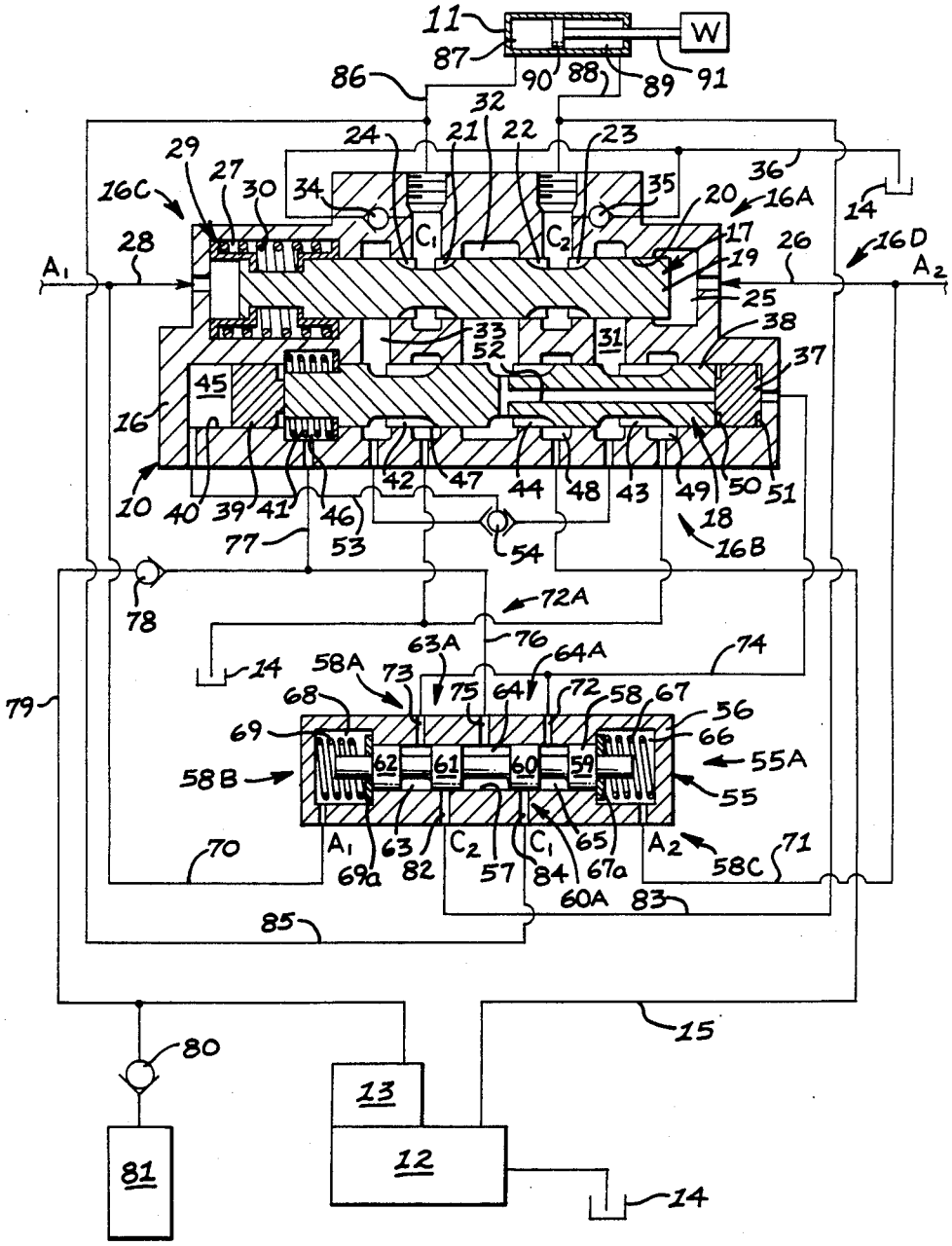
FIG. 1 is a longitudinal sectional view of an embodiment of a single stage, compensated, direction control valve responding to hydraulic control signals, together with a sectional view of a load pressure signal identifying and transmitting valve, with schematically shown system pump, pump controls, load actuator and system reservoir, all connected by schematically shown system fluid conducting lines.

Referring now to the drawings and for the present to FIG. 1, a load responsive, fully compensated, single stage valve assembly 10 is interposed between an actuator 11, operating a load W and a pump 12, provided with an output flow control 13, which may be of a bypass type, or variable displacement type, well known in the art, and which may respond, in a well known manner, to the maximum load signal pressure of the load responsive fluid power and control system of FIG. 1. The pump 12 is connected to a fluid exhaust means, such as a reservoir 14, and supplies, through discharge line 15, with pressure fluid, the valve assembly 10. The valve assembly 10 is provided with a housing 16 having a first valve means 16A and a flow control means 16B, which in this embodiment includes a direction control valve assembly 17 and a compensator assembly 18. The first valve means 16A includes a control force generating means 16C for controlling operation of the first valve means 16A. The functional control relationship, between the compensator assembly 18, which is of a single stage type and which is used in control of both positive and negative loads and the direction control valve assembly 17, is identical to that described in great detail in my U.S. Pat. No. 4,180,098, issued Dec. 25, 1979. Briefly, the direction control valve assembly 17 comprises a direction control spool 19, slidably guided in a bore 20 in the housing 16 and is provided with positive load metering slots 21 and 22 and negative load metring slots 23 and 24. One end of the direction control spool 19 projects into control space 25, subjected to pressure of the control signal $A_2$ through line 26, while the other end projects into control space 27, subjected to pressure of the control signal $A_1$, through line 28. In this embodiment, the control spaces 25,27, the control signals $A_1$,$A_2$ and the control spool 19 make up a fluid power force input means 16D. In a well known manner, the direction control spool 19 is maintained in neutral position, as shown in FIG. 1, by the centering spring assembly, generally designated as 29, located within the control space 27 and including a centering spring 30. The bore 20 intersects first exhaust chamber 31, a cylinder port $C_2$, a supply chamber 32, a cylinder port $C_1$ and a second exhaust chamber 33. The cylinder ports $C_1$ and $C_2$ communicate directly with the actuator 11, while also communicating, through check valves 34 and 35 and line 36, with the reservoir 14. The compensator assembly 18 comprises a first free floating piston 37, a throttling spool 38 and second free floating piston 39, all guided in a bore 40, provided in the housing 16. The throttling spool 38, biased by differential spring 41, is provided with negative load throttling slots 42 and 43 and positive load throttling slot 44. The positive load throttling control slots 44 and the negative load throttling control slots 42,43 respectively make up first and second throttling means. The bore 40 terminates at one end in control space 45, and intersects a chamber 46, second exhaust chamber 33, first outlet chamber 47, the supply chamber 32, an inlet chamber 48, first exhaust chamber 31, second outlet chamber 49 and control spaces 50 and 51. Control space 50 is connected by drilling 52, with the supply chamber 32. The control space 45 communicates, through line 53 and shuttle valve 54, with first exhaust chamber 31 and second exhaust chamber 33.

A second valve means 55A, such as a load pressure signal identifying valve 55 is provided in the load responsive system for identifying the type of load signal—positive or negative—and interconnecting the identified load signal with the flow control means 16B. The second valve means 55A includes a means 58A operable to identify the type of load pressure signal and a positioning means 58B to position the second valve means 55A. The load pressure signal identifying valve 55 has a housing 56, provided with a bore 57, slidably guiding a spool 58, provided with lands 59, 60, 61 and 62, defining annular spaces 63, 64 and 65. The lands 59, 60, 61 and 62 of the spool 58 and the annular spaces 63, 64 and 65 of the housing 56 make up positive and negative load pressure identifying means 63A, 64A and the lands 60,61 make up blocking means 60A. One end of spool 58 projects into space 66 and is biased by a spring 67 through a washer **67*a*, while the other end of the spool 58 projects into space 68 and is biased by a spring 69 through a washer 69*a*. Space 68 is connected through lines 70 and 28 to the control pressure signal $A_1$. Space 66 is connected through lines 71 and 26 to control pressure signal $A_2$. A fluid power force generating means 58C is part of the positioning means 58B and includes the spool 58, space 66, space 68, and the control pressure signals $A_1$,$A_2$. The positioning means 58B** is responsive to the first and second control pressure signals $A_1$,$A_2$.

A transmitting means 72A is provided and is operable to conduct the positive or negative pressure to the flow control means 16B. Annular spaces 63 and 65 are connected, through ports 72 and 73 and line 74, with control space 51. Annular space 64 is connected by port 75 and lines 76 and 77 to the chamber 46, while also being connected through check valve 78 and line 79 to the output flow control 13. Line 79 is also connected through a check valve 80 with a fluid power and control circuit, generally designated as 81. Port 82 is connected by line 83 with the cylinder port $C_2$, while port 84 is connected by line 85 with the cylinder port $C_1$. The cylinder port $C_1$ is connected by line 86 with space 87 in the actuator 11. Cylinder port $C_2$ is connected by line 88 with space 89 of the actuator 11. Spaces 87 and 89 are divided by a piston 90 and connected by a piston rod 91 to the load W.

Figure 2:
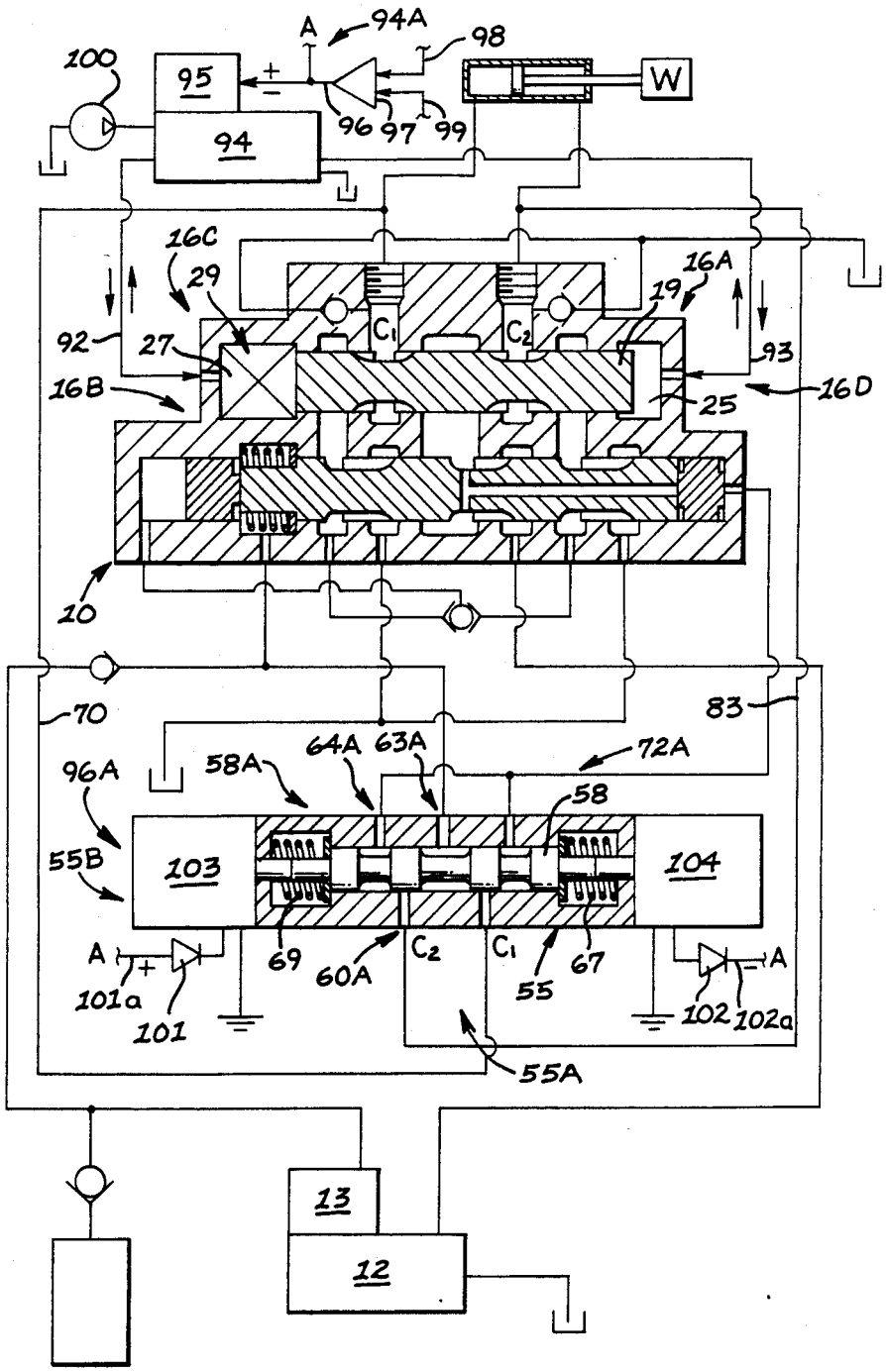
FIG. 2 shows the embodiment of the single stage, compensated, direction control valve and pressure signal identifying and transmitting valve of FIG. 1, with a direction control spool controlled by schematically shown electro-hydraulic valve, responsive to an electric control signal and load pressure signal identifying and transmitting valve, controlled by schematically shown solenoids.

Referring now to FIG. 2, the fluid power and control circuit of FIG. 2 and its basic control components are very similar to those of FIG. 1 and like components of FIGS. 1 and 2 are designated by like numerals. Valve assemblies 10 of FIGS. 1 and 2 are identical and so are the basic control elements of the load pressure signal identifying valve 55. However, in FIG. 2 a specific type of control circuit, utilized for displacement of direction control spool 19 is shown and the spool 58 of the load pressure signal identifying valve 55 is displaced in a different manner by a different force generating control than the spool 58 of FIG. 1. The control force generating means 16C of this embodiment includes an electro-hydraulic force generating means 94A that is responsive to an electrical signal 96. The direction control spool 19 utilizes schematically shown centering spring assembly 29, which is identical to the centering spring assembly 29 of FIG. 1, contained in control space 27. Control pressure signals 92 and 93, equivalent to control pressure signals $A_1$ and $A_2$ of FIG. 1, used in positioning of direction control spool 19, are generated by the electro-hydraulic force generating means 94A which includes an electro-hydraulic control valve 94, provided with an electro-hydraulic pilot stage 95, responding to an electrical control signal 96. The electrical control signal 96 is supplied from a differential amplifier 97, which is supplied with electrical command signal 98 and electrical feedback signal 99. The electro-hydraulic control valve 94 is supplied with fluid power from a fluid power source 100. The electro-hydraulic control valve 94, with its pilot stage 95, can be of a flapper nozzle or jet pipe type, well known in the art. Such an electro-hydraulic control valve 94 can provide fluid flow at a pressure proportional to the electrical signal 96, which in closed loop servo systems is called an error signal. Therefore, the pressure in control spaces 25 and 27 can be controlled, in respect to an electrical input signal.

Point A, shown in FIG. 2, is a point in the circuit, directly leading to the pilot stage 95, which may be a torque motor. The positioning means 58B of the second valve means 55A includes an electric power force generating means 96A that is responsive to the electrical control signal 96. The electric power force generating means 96A is connected to the electric control signal 96 at point A and communicates through electrical circuits, not shown, and diodes 101 and 102 with the coils of electrical solenoids 103 and 104. As is well known to those skilled in the art, the power amplifiers between point A and diodes 101 and 102 have to be utilized, to provide the necessary power to drive the electrical solenoids 103 and 104. Those amplified control signals supplied to diodes 101 and 102, are denoted as 101*a* and 102*a*. Those amplified control signals do not have to be of a modulated type as long as they supply enough power, at at least a certain minimum constant level, to the coils of the solenoids 103 and 104, so that the full displacement, in either direction of the spool 58, can take place.

Figure 3:
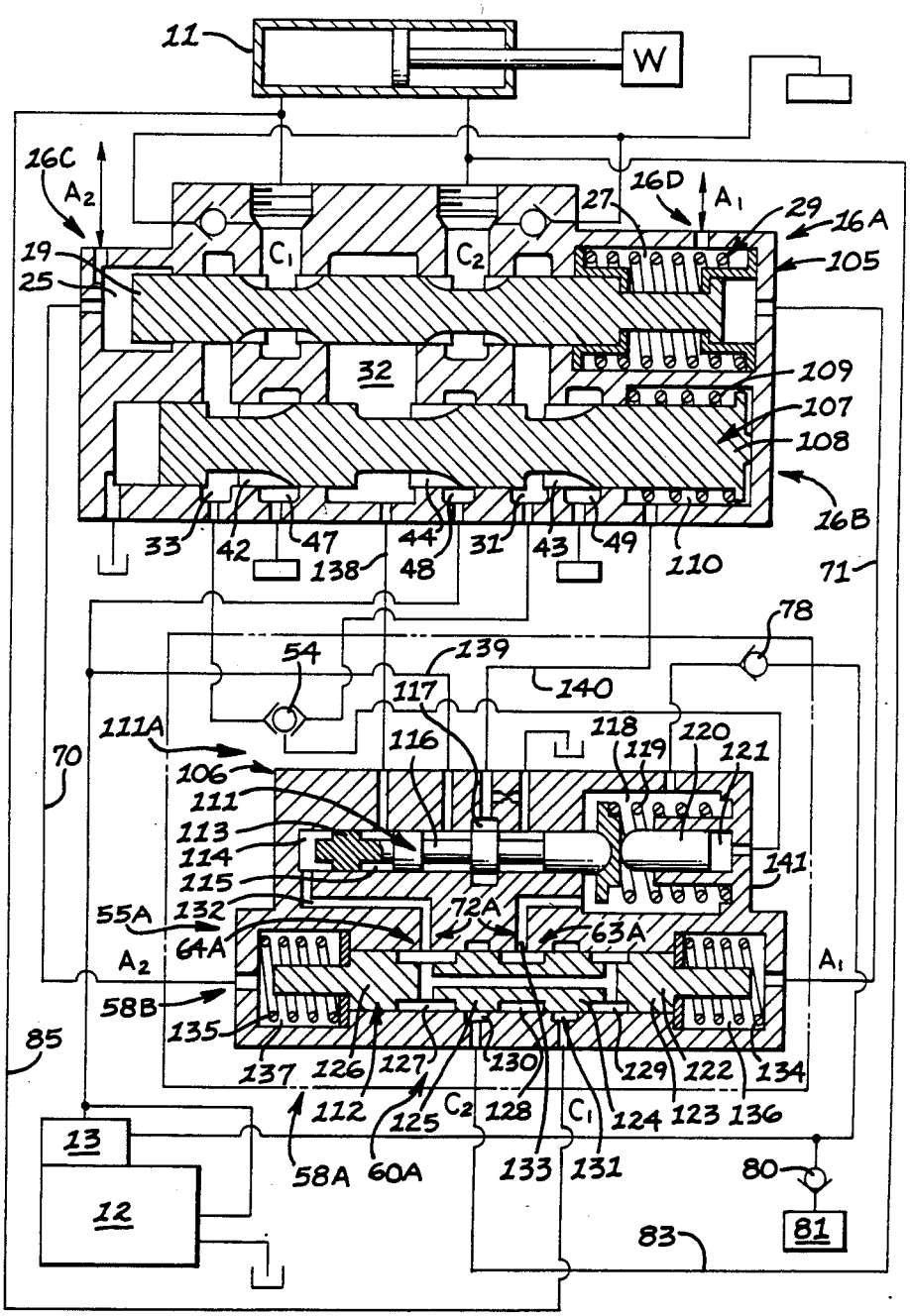
FIG. 3 is a longitudinal sectional view of an embodiment of a two stage, compensated, direction control valve, responding to hydraulic control signals, together with a sectional view of a load responsive pilot valve stage, provided with a pressure signal identifying and transmitting valve, with schemtically shown system pump, pump control, load actuator, system reservoir, shuttle valve and check valves, all connected by schematically shown system fluid conducting lines.

Referring now to FIG. 3, load responsive, fully compensated, two stage, direction valve controls are interposed between an actuator 11, ooerating a load W and a pump 12, provided with output flow control 13. The control components, including those used for identification and transmission of the load signals, of the load responsive valve of FIG. 3, are in many ways similar to those of FIG. 1 and like components of FIGS. 1 and 3 are designated by like numerals. The flow control means 16B and the first valve means 16A of the two stage direction control valve of FIG. 3 basically consist of a compensated valve assembly, generally designated as 105 and an amplifying valve assembly, generally designated as 106. The functional control relationship between the compensated valve assembly 105, used in control of both positive and negative loads and the amplifying valve assembly 106, is identical to that described in great detail in my U.S. Pat. No. 4,362,087, issued Dec. 7, 1982. Briefly, the compensated valve assembly 105 comprises a direction control spool 19, provided with a centering spring assembly 29, identical to that of FIG. 1, and a compensator spool assembly, generally designated as 107, similar to that shown in my U.S. Pat. No. 4,363,087, comprising a compensator spool 108, biased by a compensator spring 109, located in control space 110. A fluid power amplifying means 111A of the amplifying valve assembly 106 includes a pilot valve assembly, generally designated as 111 and is operable to control the first and second throttling means 44,42,43. The pilot valve assembly 111 comprises a free floating piston 113, communicating with control space 114 and space 115; a pilot valve spool 116, positioned in respect to control port 117 and projecting into control space 118; a differential spring 119; and a free floating piston 120 in communication with control space 121. The load pressure signal identifying valve 112 is provided with a spool 122, provided with lands 123, 124, 125 and 126, defining annular spaces 127, 128 and 129. Land 125 works in cooperation with annular groove 130, while land 124 works in cooperation with annular groove 131. Annular space 127 is connected by a drilling 132 with control space 114, while annular space 128 is connected by drilling 133 with control space 118. The annular spaces 127,128; the drillings 132,132 and their interrelationship with the pressure signal identifying valve 112 make up the transmitting means 72A of this embodiment. The spool 122 is biased towards its neutral position by springs 134 and 135, each respectively positioned in chambers 136 and 137. Space 115 is connected by line 138 with the supply chamber 32. Line 139 supplies the pilot valve assembly 111 with high pressure oil from the pump 12. Line 140 cvonnects control port 117 with control space 110. The pilot valve assembly 111 and load pressure signal identifying valve 112 are contained within a single body 141. The load pressure signal identifying valve 112 of this embodiment makes up the second valve means 55A.

Figure 4:
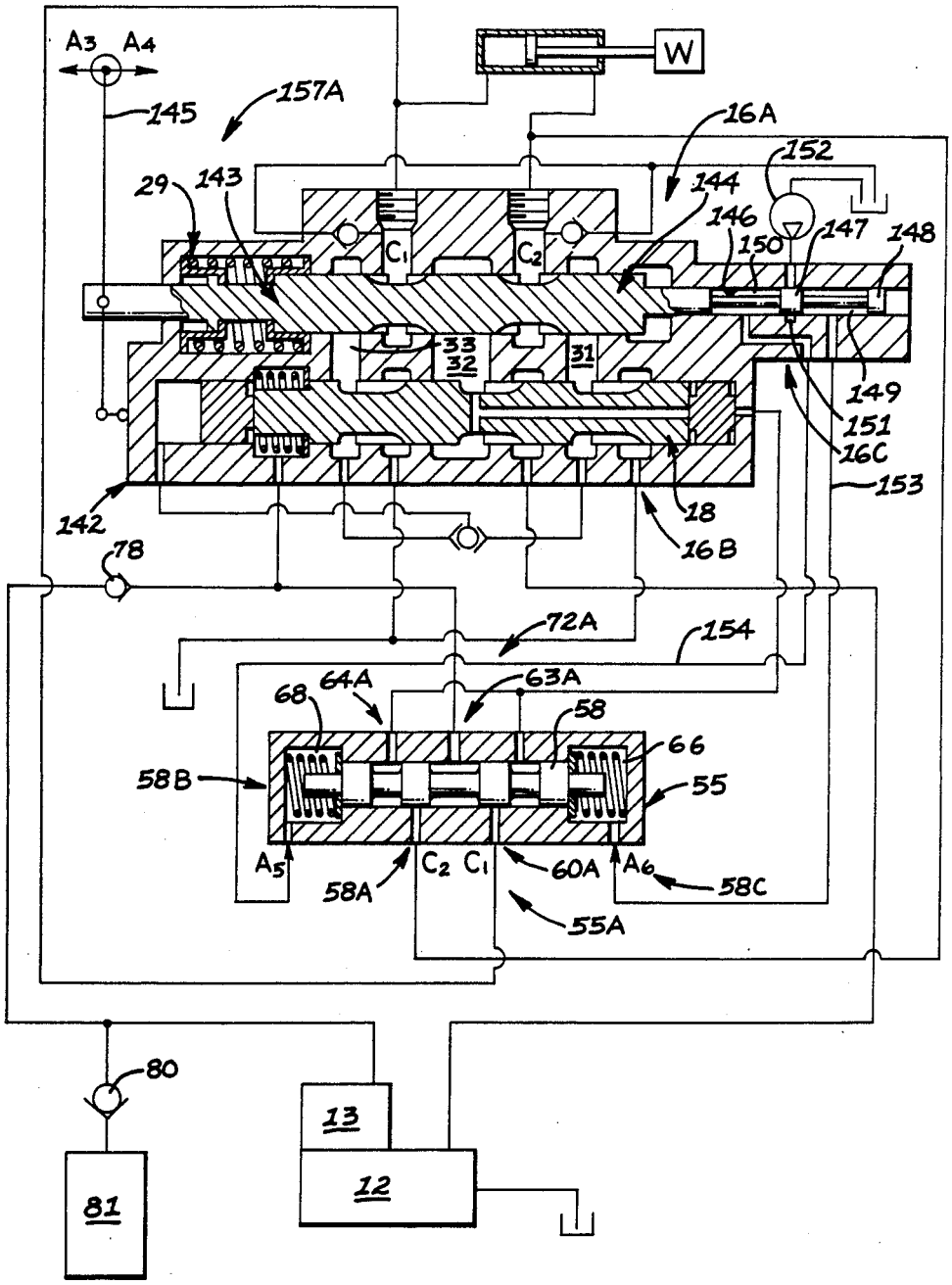
FIG. 4 shows the embodiment of a single stage, compensated, direction control valve, provided with a control signal generating section, responsive to a manual control signal, together with a sectional view of the load pressure signal identifying and transmitting valve of FIG. 1, with schematically shown system pump, pump control, load actuator, source of control pressure and system reservoir, all connected by schematically shown system fluid conducting lines.

Referring now to FIG. 4, the fluid power and control circuit of FIG. 4 and its basic control components are very similar to those of FIGS. 1 and 2 and like components of FIGS. 1, 2 and 4 are designated by like numerals. The flow control means 16B and first valve means 16A of this embodiment includes a valve assembly, generally designated as 142, composed of a compensator assembly 18, identical to those of FIGS. 1 and 2 and a direction control valve assembly, generally designated as 143, which is provided with a central portion of a direction control spool, generally designated as 144, which is identical to the direction control spool 19, of FIGS. 1 and 2 and uses the same centering spring assembly 29. One end of the direction control spool 144 is connected to a manually operated control lever 145, subjected to manual input control signals $A_3$ and $A_4$. The other end of the direction control spool 144 protrudes into bore 146 and with control land 147 and land 148 defines annular spaces 149 and 150. The control land 147 with direction controls spool 144 in its neutral position, blocks port 151, which is connected to a source of control pressure 152. Annular space 149 is connected by line 153 with space 66 of the load pressure signal identifying valve 55. Annular space 150 is connected by line 154 with space 68 of load pressure signal identifying valve 55. The control lever 145 and the control land 147 associated with the direction control spool 144 make up the control force generating means 16C of this embodiment.

Figure 5:
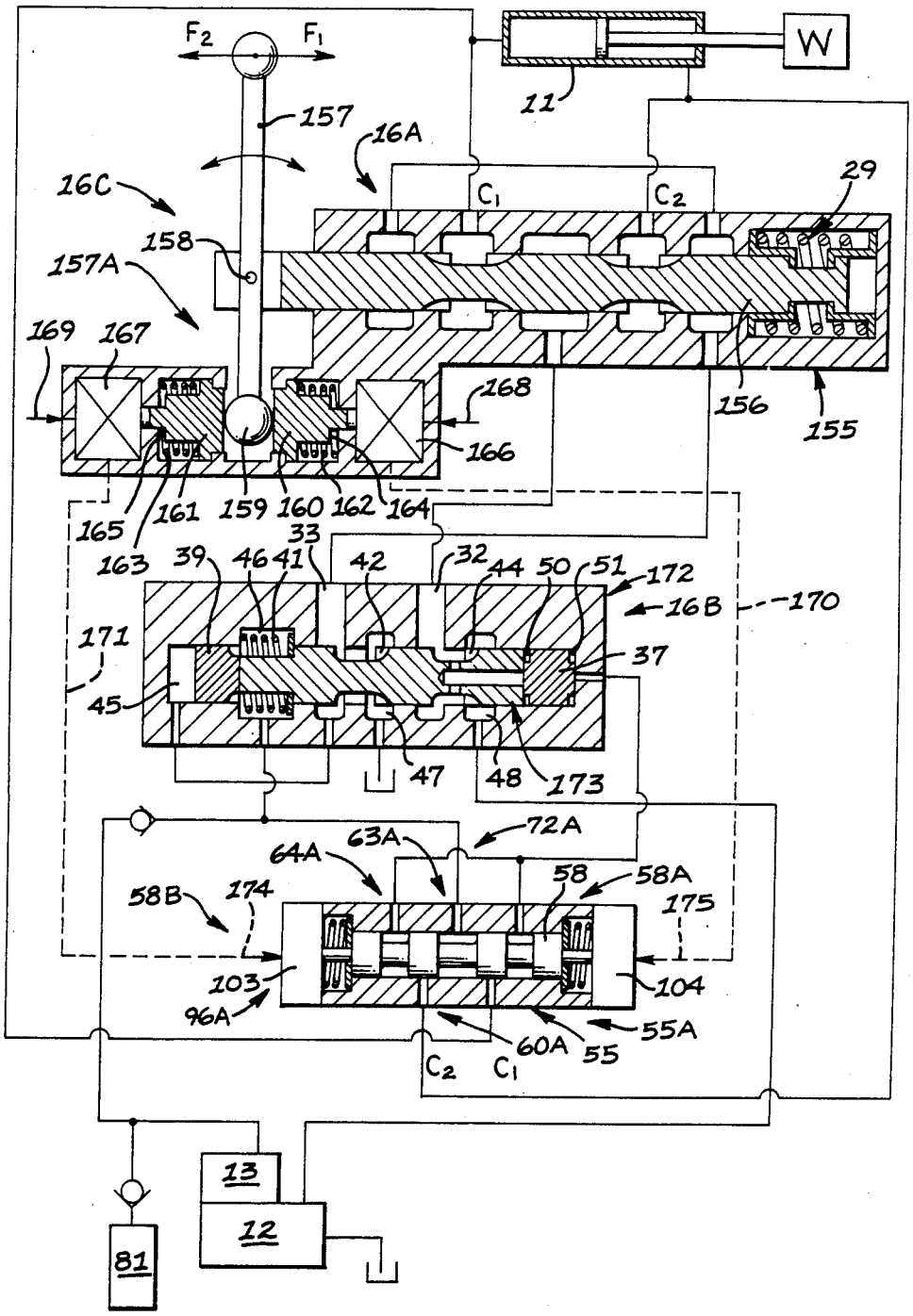
FIG. 5 is a longitudinal sectional view of an embodiment of a manually controlled direction control valve, provided with manually controlled electrical signal generators, together with a sectional view of a single stage, load responsive compensating valve and a sectional view of an electrically operated pressure signal identifying and transmitting valve, with schematically shown system pump, pump control, load actuator, system reservoir, and check valves, system fluid conducting and electrical lines being shown schematically.

Referring now to FIG. 5, the fluid power and control circuit of FIG. 5 and its basic control components are very similar to those of FIGS. 1 and 2 and like components of FIGS. 1, 2 and 5 are designated by like numerals. The first valve means 16A of this embodiment includes a direction control spool assembly, generally designated as 155, provided with a direction control spool 156, very similar to the direction control spool 19 of FIG. 1, but connected for direct operation to a manual force input means 157A, such as, a manual lever 157. The centering spring assembly 29 of FIGS. 1 and 5 are identical. In a well known manner, the resistance of the centering spring assembly 29, to the displacement of the direction control spool 156, in either direction, must be overcome by a certain minimum force F, applied to the manual lever 157. Again, in a well known manner, this minimum force F, transmitted around the pivot point 158, positioned on the direction control valve spool 156, will result in a proportional reaction force, transmitted by the spherical end 159, of the manual lever 157, against the surfaces of the reaction members 160 and 161, which are biased towards position as shown by the springs 162 and 163. Shoulders 164 and 165 on the reaction members 160 and 161, limit the maximum displacement of those reaction members. The reaction members 160 and 161 operationally engage electrical switching elements 166 and 167, which are provided with electrical power at connections 168 and 169. The switching elements 166 and 167 are connected by electrical lines 170 and 171 to solenoids 103 and 104 and transmit to those solenoids control signals 174 and 175. The solenoids 103 and 104 are identical to the solenoids of FIG. 2, which also work in operational engagement with the load pressure signal identifying valve 55, again identical to that of FIGS. 1 and 2. The flow control means 16B of this embodiment includes a compensated valve assembly, generally designated as 172 which includes a compensator assembly 173, very similar to the compensator assemblies 18 of FIGS. 1 and 2.

Referring now back to FIG. 1, with the direction control spool 19 maintained in its neutral position, as shown in FIG. 1, by the centering spring assembly 29, the cylinder ports $C_1$ and $C_2$ are completely isolated from the supply chamber 32 and first and second exhaust chambers 31 and 33. At the same time, as shown in FIG. 1, the connection from the cylinder port $C_1$ through line 85 and port 84 is blocked by land 60 of the spool 58, while the connection from cylinder port $C_2$, through line 83 and port 82, is blocked by land 61. Under those conditions, depending on its direction, the load W will be supported by a pressure, generated in space 87, or space 89, acting on the cross-sectional area of the piston 90 of the actuator 11 and spaces 87 and 89 are completely isolated from each other with the load W remaining stationary.

Assume that the direction control spool 19 is displaced by the pressure in the control space 27, generated by the control signal $A_1$, against the centering force of the centering spring assembly 29 from left to right, connecting the cylinder port $C_1$ through the positive load throttling slot 21 with the supply chamber 32, while also connecting the cylinder port $C_2$ through the negative load metering slot 23, with the first exhaust chamber 31. This direction of the displacement of the direction control spool 19 automatically dictates the direction of displacement of the load W, through the action of the actuator 11 and this direction of displacement of the load W must take place from left to right. Under those conditions, if the direction of the load W is such, that it is supported by the pressure in the space 87 of the actuator 11, the load W must be moved from left to right by the energy supplied from the pump 12 and through the flow of pressurized fluid from the supply chamber 32 to the space 87, while the space 89, subjected to low pressure, is connected, by the direction control spool 19, to the first exhaust chamber 31. Under those conditions, since displacement of the load W must be accomplished by the energy supplied from pump 12, the load W is called positive.

With the direction of displacement of the load W from left to right, as predetermined by the direction of displacement of the control spool 19, if the direction of the load W is such that it is supported by the pressure in the space 89 of the actuator 11, the potential energy, stored in the load W will be used for displacement of the load and the pressurized fluid, from the cylinder port $C_2$, will be throttled, on its way to the system reservoir and no energy has to be supplied from the pump 12 to space 87, to cause displacement of the load W. Under those conditions, since displacement of the load W will be accomplished by the energy supplied from the load itself, the load W is called negative. Therefore, both the direction of displacement of the spool 19 and the direction of the force developed by the load W will determine if the load W is positive or negative.

With the direction control spool 19 displaced by the pressure in the control space 25, provided by the control signal $A_2$, against the centering force of the centering spring assembly 29 from right to left, the cylinder port $C_2$ through the positive load metering slot 22, will be connected to the supply chamber 32 and the cylinder port $C_1$ will be connected through the negative load metering slot 24 to the second exhaust chamber 33. This direction of displacement of the direction control spool 19 will automatically determine the displacement of the load W from right to left. Again, as previously described, with this specific direction of displacement of the direction control spool 19 the direction of the force, developed by the load W, will determine whether the load W is positive or negative. Therefore, as previously stated, under all operating conditions, both the direction of displacement of the spool 19 and the direction of the force developed by the load W will determine whether the load W is positive or negative.

In load responsive compensated systems, well known in the art, control of the load is accomplished by the throttling action of the load responsive controls, which maintain a constant pressure differential across a metering orifice, interposed between the actuator controlling the load and the system itself. If the load is positive the throttling action of those load responsive controls takes place between the system pump and the metering orifice. If the load is negative the throttling action of those load responsive controls takes place between the metering orifice and the system reservoir. Since different types of throttling controls are used in the control of positive and negative loads, and since those controls are responsive to the magnitude of the load pressure, it is essential for proper operation of the system, not only to identify the type of load being controlled as being positive or negative, but also to transmit the load pressure signals to the positive or negative load responsive throttling controls of the system, with minimum attenuation of those signals. By the very nature of the determination of the type of the load, in respect to the direction of the load displacement, at any specific time, the load can only be either positive or negative, necessitating the control action, at a time, either of the positive or negative load responsive throttling controls.

The control action of the positive and negative load throttling controls, of the control system of my U.S. Pat. No. 4,180,098 is essentially the same as that of the controls of the valve assembly 10 of FIG. 1. However, in my U.S. Pat. No. 4,180,098 the identification of the type of load, be it positive or negative, and transmittal of the positive or negative load pressure signal to the appropriate positive or negative load throttling control, is accomplished by the displacement of the direction control spool, in respect to negative or positive load sensing ports, connected to load pressure signal conducting passages. This method of identification and transmittal of the positive and negative load pressure signals is well known in the art and results not only in a well known increase in the so called dead band of the valve, but also produces the undesirable effect of a slower response of the load responsive throttling controls. Those load responsive controls may be either the positive or negative load throttling controls of the control valve itself, or when combined with the check valve logic system, well known in the art, may be the load responsive controls of the system pump.

In the control arrangement of FIG. 1, the identification of the load pressure signals as positive or negative and interconnection of thos identified load pressure signals to the positive and negative load throttling controls of valve assembly 10 is accomplished by the load pressure signal identifying valve, generally designated as 55.

The increase in pressure of the control signal $A_1$ resulting in displacement of the direction control spool 19 from left to right, is transmitted through line 70 to space 68 and automatically results in full displacement to the right of the spool 58, against the biasing force of spring 67. This displacement to the right of spool 58 forms two distinct load pressure signal transmitting circuits. One of those circuits consists of line 83, connected to cylinder port $C_2$ and port 82, which becomes directly interconnected through annular space 63, port 73 and line 74 to control space 51 and becomes a negative load pressure signal transmitting circuit, with port 72 being blocked by land 60. The other circuit consists of line 85 connecting the $C_1$ cylinder port with port 84, which in turn becomes connected through annular space 64, port 75 and lines 76 and 77 with the chamber 46 and becomes a positive load pressure signal transmitting circuit. This positive load pressure signal transmitting circuit, through the check valve 78, in a well known manner, depending on the magnitude of the signal pressure, may be connected to the output flow control 13 of the pump 12. Whether the load pressure signals are transmitted through the positive or the negative load pressure signal transmitting circuits depends entirely on the direction of the force, exerted by the load W. With the load W exerting force, which generates pressure in space 87 of the actuator 11, a positive load pressure signal will be transmitted through the positive load pressure signal transmitting circuit, while the negative load pressure signal transmitting circuit will be subjected to reservoir pressure. With the force of load W generating pressure in space 89 of the actuator 11, the negative load pressure signal will be transmitted to the negative load pressure signal transmitting circuit, while the positive load pressure signal transmitting circuit will be subjected to reservoir pressure. The transmittal of the positive or negative load pressure signals will take place with all ports and passages of the positive and negative load pressure transmitting circuits fully open and with minimum attenuation of the load pressure signals.

The increase in pressure of the control signal $A_2$, resulting in displacement of the direction control spool 19 from right to left, is transmitted through line 71 to space 66 and automatically results in full displacement to the left of the spool 58, against the biasing force of spring 69. This displacement to the left of spool 58, in a manner similar to that described above, forms again two distinct positive and negative load pressure signal transmitting circuits. The positive load pressure signal transmitting circuit connects cylinder port $C_2$ with the chamber 46 and the check valve 78 and consists of line 83, port 82, annular space 64, port 75 and lines 76 and 77. The negative load pressure signal transmitting circuit connects cylinder port $C_1$ with control space 51 and consists of line 85, port 84, annular space 65, port 72 and line 74, while port 73 is blocked by the land 61.

With positive load pressure signal transmitting circuit transmitting a positive load pressure signal from either cylinder port $C_1$ or $C_2$, with direction control spool 19 displaced in either direction, the chamber 46 will be subjected to positive load pressure, while the control space 50 will be subjected through drilling 52 to pressure in the supply chamber 32. Then the throttling spool 38 will assume a modulating position, throttling by positive load throttling slot 44, the flow of fluid from the inlet chamber 48, connected to the pump 12, to the supply chamber 32, to automatically maintain a constant pressure differential, equivalent to preload in the differential spring 41, across an orifice, caused by the displacement of the positive load metering slot 21 or 22.

With the negative load pressure signal transmitting circuit transmitting a negative load pressure signal from either cylinder port $C_1$ or $C_2$, with direction control spool 19 displaced in either direction, the control space 51 will be subjected to negative load pressure, while control space 45 will be subjected to the pressure of either first exhaust chamber 31, or second exhaust chamber 33, through the well known action of the shuttle valve 54. Then the combination of throttling spool 38, first free floating piston 37 and second free floating piston 39, all in contact with each other, will assume a modulating position, throttling by negative load throttling slot 42 or 43, the flow of fluid from the second exhaust chamber 33, or first exhaust chamber 31 to first outlet chamber 47, or the second outlet chamber 49, to automatically maintain a constant pressure differential, equivalent to the preload in the differential spring 41, across an orifice, caused by the displacement of the negative load metering slot 23 or 24.

Assume that the control pressure signal $A_1$ or $A_2$ is small enough, so that it will not overcome the preload in the centering spring 30, but at the same time is large enough to cause full displacement of the spool 58, against the biasing force of spring 69 or 67 in either direction. The presence of such a small control signal $A_1$ or $A_2$ will not cause the displacement of the direction control spool 19, but will through the action of the load pressure signal identifying valve 55, in a manner as previously described, fully activate the positive and negative load pressure signal transmitting circuits. Therefore, with the direction control spool 19 in its neutral position, in anticipation of a control signal, strong enough to displace the direction control spool 19, either the positive or negative load throttling controls will be fully activated and will assume an equilibrium control position, equivalent to flow through a control orifice of zero area. Any displacement of the direction control spool 19 from its neutral position will create a metering orifice, with an appropriate positive or negative load throttling control already fully activated and in a modulating position, requiring only minimal displacement to control the pressure differential across the orifice. This anticipation feature is unique and extremely beneficial, since it provides a very fast responding and stable control with linear control characteristics.

The load pressure identifying and transmitting circuit of FIG. 1, with its load pressure signal identifying valve 55, permits not only use of the direction control spool 19 with essentially a zero dead band, but it also greatly simplifies the design of the direction control spool 19 and the housing 16. In the absence of the control pressure signals $A_1$ and $A_2$ the cylinder ports $C_1$ and $C_2$ and therefore spaces 87 and 89 of the actuator 11 are completely isolated by the direction control spool 19 and by lands 60 and 61 of the spool 58, of the load pressure signal identifying valve 55.

FIG. 1 shows control spaces 25 and 27 directly connected by fluid conducting lines to spaces 66 and 68 of the load pressure signal identifying valve 55. Fluid power amplifying devices can be inserted into those fluid conducting lines, so that the displacement of the spool 58 takes place at very low control pressures in control spaces 27 and 25. Spaces 66 and 68 can also be supplied with control pressure in response to control signals other than $A_1$ and $A_2$, as long as those control signals are synchronized with the pressure levels existing in the control spaces 25 and 27.

Referring now back to FIG. 2, in a manner identical to that as described when referring to FIG. 1, the direction of displacement of the direction control spool 19, in response to control pressure signals 92 and 93, together with the direction of the force generated by the load W, will determine whether the load W is positive or negative. The type of load W is identified and the positive and negative load transmitting circuits are established by the load pressure signal identifying valves 55 of FIGS. 1 and 2, in an identical way, as already described when referring to FIG. 1. The only basic difference between the embodiments of FIGS. 1 and 2 is the method of generation of the force, necessary to displace the spool 58. In FIG. 1 the spool 58 is moved by the force, generated by the control pressure, which also moves the direction control spool 19. In FIG. 2 the direction control spool 19 is still operated by the control pressure, but the spool 58 of the load pressure signal identifying valve 55 is directly displaced by the force, generated in the electrical solenoids 103 and 104. The coil of the electrical solenoid 103 is connected to point A through an electrical circuit, not shown, and through the diode 101, well known in the art, which permits transmittal of the current at positive voltage. The coil of electrical solenoid 104 is connected to point A through an electrical circuit, not shown, and through diode 102, well known in the art, which permits transmittal of the current at negative voltage. As is well known to those skilled in the art, power amplifiers between point A and the diodes 101 and 102 have to be utilized, to provide the necessary power to drive the solenoids and result in the generation of control signals 101*a* and 102*a*.

The positive or negative voltage of the electrical signal 96 will automatically establish, in a well known manner, through the action of pilot stage 95 and electro-hydraulic control valve 94, the intended direction of displacement of the direction control spool 19. If the voltage of the electrical signal 96 is positive, the direction control spool 19 will move in one direction and if this voltage is negative, it will move in the other direction. This positive and negative voltage of the electrical signal 96, sampled at point A, in a manner as described above, through the appropriate amplifying circuits and diodes 101 and 102, transmitting power to solenoids 103 and 104, will move the spool 58 in the required direction through its full displacement, against the force of biasing springs 69 and 67. In this way the direction of displacement of spool 58 corresponds directly to the direction of displacement of direction control spool 19, automatically establishing, in a manner as described when referring to FIG. 1, positive and negative load pressure signal transmitting circuits.

The arrangement of FIG. 2 is especially useful, when applied to closed loop servo systems, in which the electrical signal 96 becomes the error signal from the differential amplifier 97.

Referring now back to FIG. 3, as fully described, when referring to FIGS. 1 and 2, the direction of displacement of the direction control spool 19, in response to the control pressure signals $A_1$ and $A_2$, together with the direction of force of load W, will establish whether load W is positive or negative. The control pressures, in control spaces 25 and 27, established by control pressure signals $A_1$ and $A_2$, not only determine the displacement of the control spool 19, but are also transmitted through lines 70 and 71 to chambers 137 and 136 and, in a manner as fully described when referring to FIGS. 1 and 2, will result in full displacement of the spool 122 in either direction, against the force of springs 134 and 135. As previously described when referring to FIGS. 1 and 2, the displacement of spool 122, in either direction from its neutral position, will establish positive and negative load pressure signal transmitting circuits, all contained within the body 141.

With spool 122 displaced from left to right, the positive load identifying and transmitting circuit will connect the cylinder port $C_1$ through line 85, annular groove 131, annular space 128 and drilling 133 with control space 118. At the same time the negative load identifying and transmitting circuit will connect the cylinder port $C_2$ through line 83, annular groove 130, annular space 127 and drilling 132 with control space 114.

With the spool 122 displaced all the way from right to left, the positive load identifying and transmitting circuit will connect cylinder port $C_2$ through line 83, annular groove 130, annular space 128 and drilling 133 with control space 118. At the same time the negative load identifying and transmitting circuit will connect the cylinder port $C_1$ through line 85, annular groove 131, annular space 129, which is connected through an unnumbered drilling in the spool 122 with annular space 127, and drilling 132 with the control space 114.

In the load pressure signal identifying valve 112 the lands 124 and 125 overlap, by any selected length, annular grooves 130 and 131. Therefore, with the arrangement of FIG. 3 a very small displacement of the control spool 122, in either direction, can establish positive and negative load pressure signal identifying and transmitting circuits. This type of arrangement results in very fast response and a minimal amount of fluid, diverted for displacement of the valve spool 122 from control spaces 25 and 27. Therefore this type of arrangement can be used in applications where $A_1$ and $A_2$ control pressure signals are generated, for example, by an electro-hydraulic servo valve.

If the control pressure of control pressure signals $A_1$ and $A_2$ will displace the spool 122, while the direction control spool 19 is still maintained, in its neutral position, by the centering spring assembly 29, as previously described when referring nto FIGS. 1 and 2, the load pressure identifying and transmitting circuit will be provided with an anticipation feature and establish the negative and positive load pressure transmitting circuits, before the direction control spool 19 is moved from its neutral position. As previously described when referring to FIGS. 1 and 2, this feature will greatly improve the response and stability of the control.

In FIGS. 1 and 2 the positive and negative load pressure transmitting circuits are transmitting the load pressure signals directly to the compensator assembly 18, since the load responsive control of FIGS. 1 and 2 is of a single stage type. In the arrangement of FIG. 3 those positive and negative load pressure transmitting circuits transmit the load pressure signals to the pilot valve assembly 111, since the load responsive control of FIG. 3 is of a two stage type. Such a control was described in detail in my U.S. Pat. No. 4,362,087.

When controlling a positive load, the pilot valve spool 116, subjected to pressure from the supply chamber 32, transmitted by line 138 to space 115 and to the positive load pressure in control space 118, will assume a modulating position, regulating fluid flow and pressure from control port 117, which is connected by line 140 with control space 110. Subjected to the pressure in control space 110, the compensator spool 108 will in turn assume a modulating position, throttling by positive load throttling slot 44 the fluid flow from the inlet chamber 48 to the supply chamber 32, to maintain a constant pressure differential across an orifice, created by displacement of the direction control spool 19.

When controlling a negative load, the pilot valve spool 116, together with the free floating pistons 113 and 120, subjected to negative load pressure in control space 114 and to the higher pressure of the first exhaust chamber 31 and second exhaust chamber 33, through the action of the shuttle valve 54, will assume a modulating position controlling the pressure and the fluid flow to and from control port 117. Control port 117 is connected by line 140 to the control space 110. Subjected to pressure in the control space 110 the compensated spool 108 in turn will assume a modulating position, throttling the fluid flow with negative load throttling slot 43, or the negative load throttling slot 42, the fluid flow, between the first exhaust chamber 31 and second outlet chamber 49, or throttling the fluid flow from the second exhaust chamber 33 to the first outlet chamber 47, to maintain a constant pressure differential, equivalent to the biasing force of the compensator spring 109, across an orifice, created by displacement of the direction control spool 19.

Referring now back to FIG. 4, since the compensator assembly 18 and the load pressure signal identifying valve 55 are identical to those of FIG. 1, in response to pressure signals $A_5$ and $A_6$ transmitted to spaces 66 and 68, identical positive and negative load identifying and transmitting circuits are formed. The basic operation and special characteristics of such circuits were described in detail, when referring to FIG. 1. The difference between the controls of FIG. 1 and FIG. 4 lies in the method of generation of the control signals $A_5$ and $A_6$, transmitted to spaces 68 and 66 of the load pressure signal identifying valve 55.

Clockwise displacement of the control lever 145, subjected to manual control signal $A_4$, results in the displacement from left to right of the direction control valve spool 144 with its control land 147. A very small displacement of control land 147 to the right will connect the source of control pressure 152 and port 151 with annular space 150, line 154 and space 68, thus generating control signal $A_5$, resulting in displacement of the spool 58, of the load pressure signal identifying valve 55, all the way to the right, while the supply chamber 32, cylinder ports $C_1$ and $C_2$ and first and second exhaust chambers 31 and 33 are still isolated from each other by the lands of the direction control spool 144. Further displacement of the direction control spool 144 to the right will connect by metering orifices the cylinder port $C_1$ with the supply chamber 32 and cylinder port $C_2$ with first exhaust chamber 31.

Anticlockwise rotation of the control lever 145, subjected to manual control signal $A_3$, through displacement of the control land 147 will connect the source of control pressure 152, through annular space 149 and line 153, with the space 66 and generate control signal $A_6$, resulting in full displacement of the spool 58 from right to left, while the supply chamber 32, cylinder ports $C_1$ and $C_2$ and first and second exhaust chambers 31 and 33 are still isolated from each other by the lands of the direction control spool 144. Further displacement to the left of the direction control spool 144 will create metering orifices between the supply chamber 32 and the cylinder port $C_2$ and between cylinder port $C_1$ and the second exhaust chamber 33.

In response to manual input control signals $A_3$ and $A_4$ and control pressure signals $A_5$ and $A_6$, the load pressure signal identifying and transmitting circuits will be formed in an identical way, as described when referring to FIG. 1. The compensated controls of FIG. 4 will perform in an identical way in response to the load pressure signals, as those of FIG. 1.

In the embodiment of FIG. 4 the identification and formation of the load pressure signal transmitting circuits must be originated by a small displacement of the direction control spool 144 from its neutral position. This displacement can be very small, but it still results in the formation of load pressure signal transmitting circuits with full flow capacity and minimum attenuation of the load pressure signal. Therefore, the embodiment of FIG. 4 has only a measure of the anticipation feature of FIGS. 1 and 2, in which with the direction control spool in its neutral position, the load pressure signal identifying and transmitting circuits can be activated.

Referring now back to FIG. 5, in a manner identical to that as described when referring to FIG. 1, the direction of displacement of the direction control spool 156, in response to the manual input signal from the manual lever 157, together with the direction of the force generated by the load W, will determine whether the load W is positive or negative. The type of load W is identified and the positive and negative load pressure signal transmitting circuits are established by the load pressure signal identifying valves of FIGS. 1 and 5 in an identical way, as already described when referring to FIG. 1. The only basic difference between the embodiments of FIG. 1 and FIG. 5 is the difference in control of displacement of the direction control valve spool 156, which in FIG. 5 is done manually, and the method of generation of the force, necessary to displace the spool 58, which in FIG. 5 is directly displaced by the force, generated in the electrical solenoids 103 and 104, in an identical manner as shown in FIG. 2.

A certain minimum force, as established by the centering spring assembly 29, resists the displacement of the direction control spool from its neutral position, in either direction. This minimum force must be supplied to the direction control spool 156 through the pivot 158 from the manual lever 157 and is equivalent to the force $F_1$ or $F_2$, applied to the end of the manual lever 157. In a well known manner application of force $F_1$ or $F_2$ to the manual lever 157, with pivot 158 stationary, will generate a proportional reaction force, which is applied through the spherical end 159 to the surfaces of reaction member 160 or 161. The preload in the springs 162 and 163 is so selected, that the reaction members 160 and 161 are displaced through a very short distance, as determined by the shoulders 164 and 165, activating the switching element 166 or 167. The switching element 166 or 167 is activated before the direction control spool 156 is displaced from its neutral position. The switching elements 166 and 167 may be of a type like a microswitch, well known in the art, which when subjected to a very short mechanical displacement connects the source of electrical power to any type of element, responding to electrical power. As shown in FIG. 5, the switching elements 166 and 167 connect electrical power to the coils of the solenoids 103 and 104 by control signals 174 and 175, which solenoids displace, in a manner as described when referring to FIG. 2, the spool 58 through its full stroke in either direction.

A very small displacement of the manual lever 157, in a clockwise direction, will first displace by the spherical end 159, through a very short distance, the reaction member 161, against the biasing force of the spring 163, until the shoulder 165 engages the reaction surface. This short displacement of the reaction member 161 will generate control signal 174 by connecting the electrical power through electrical line 171 to the solenoid 103, which will move the spool 58 all the way from left to right. In this way, in a manner as described when referring to FIG. 1, the load identifying and transmitting circuits of the control embodiment of FIG. 5 are established, with the direction control spool 156 still in its neutral position. Further clockwise rotation of the manual lever 157 will displace the direction control spool 156 from right to left, create metering orifices leading to the cylinder ports $C_1$ and $C_2$, which in turn will automatically initiate the throttling action of the compensated valve assembly 172. If a positive load is being controlled the control throttling action will take place at the positive load throttling slot 44. If a negative load is being controlled, the throttling action will take place at the negative load throttling slot 42.

Anticlockwise rotation of the manual lever 157 in an identical way as previously described will generate a control signal 175 by activating the switching element 166 and solenoid 104, displacing the spool 58 all the way from right to left, establishing the identifying and transmitting circuits of the load pressure signals, with the direction control spool 156 in its neutral position. Further anticlockwise rotation of the manual lever 157 will displace from right to left the direction control spool 156, initiating the displacement of the load W.

All of the load responsive controls of FIGS. 1 to 5 automatically provide, during control of both positive and negative loads, a displacement of the load W, the velocity of which is always proportional to the displacement of the direction control spool from its neutral position.

The embodiment of FIG. 5, with direction control spool 156 manually operated, provides the anticipation feature of FIG. 1, so that the load responsive system throttling controls can be fully activated, before displacement of the direction control spool 156 takes place. As previously described this provides a load responsive control characterized by high response and linear characteristics, with minimum attentuation of the load pressure signals. The embodiment of FIG. 5 shows a load responsive control of a single stage type. The single stage control can be easily substituted by the two stage control of FIG. 3, with the basic load pressure signal identifying and transmitting circuit remaining the same.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

I claim:

1. In a load responsive system including a fluid power actuator operable to control a positive or negative load W, a source of pressure fluid, fluid exhaust means, flow control means of said load responsive system and first valve means for selectively interconnecting said actuator with said source of pressure fluid and said fluid exhaust means and to direct the flow of fluid subjected to positive type and negative type load pressures, control force generating means responsive to a first and second control signal and operable to control the position of said first valve means, second valve means having positioning means and means operable to identify the type of load pressure signal, and transmitting means operable to supply said identified type of load pressure signal to said flow control means of said load responsive system.

2. A load responsive system as set forth in claim 1 wherein said means operable to identify the type of load pressure signal has a positive load pressure identifying means and said transmitting means has means operable to conduct said positive load pressure signal to the controls of said source of pressure fluid.

3. A load responsive system as set forth in claim 1 wherein said means operable to identify the type of load pressure signal has a positive load pressure identifying means and said transmitting means has means operable to conduct said positive load pressure signal to the positive load throttling controls of said flow control means of said load responsive system.

4. A load responsive system as set forth in claim 1 wherein said means operable to identify the type of load pressure signal has a positive load pressure identifying means and blocking means operable to isolate said positive load pressure from said transmitting means in the absence of said first and said second control signal.

5. A load responsive system as set forth in claim 1 wherein said means operable to identify the type of load pressure signal has a negative load pressure identifying means and said transmitting means has means operable to conduct said negative load pressure signal to the negative load throttling controls of said flow control means of said load responsive system.

6. A load responsive system as set forth in claim 1 wherein said means operable to identify the type of load pressure signal has a negative load pressure identifying means and blocking means operable to isolate said negative load pressure from said transmitting means in the absence of said first and said second control signal.

7. A load responsive system as set forth in claim 1 wherein said means operable to identify the type of load pressure signal has a positive and negative load pressure identifying means and said transmitting means has means operable to conduct said negative and said positive load pressure to the positive and negative load pressure throttling controls of said flow control means of said load responsive system.

8. A load responsive system as set forth in claim 1 wherein said means operable to identify the type of load pressure signal has a positive and a negative load pressure identifying means and blocking means operable to isolate said positive and said negative load pressure from said transmitting means in absence of said first and said second control signal.

9. A load responsive system as set forth in claim 1 wherein said control force generating means includes fluid power force input means.

10. A load responsive system as set forth in claim 1 wherein said control force generating means includes manual force input means.

11. A load responsive system as set forth in claim 1 wherein said positioning means of said second valve means includes electric force generating means having means responsive to an electric input signal.

12. A load responsive system as set forth in claim 1 wherein said positioning means of said second valve means includes electric force generating means having means responsive to a manual input signal.

13. A load responsive system as set forth in claim 1 wherein said positioning means of said second valve means includes fluid power force generating means having means responsive to said first and second control signal.

14. A load responsive system as set forth in claim 1 wherein said fluid power force generating means includes means responsive to a manual input signal.

15. A load responsive system as set forth in claim 1 wherein said flow control means of said load responsive system include first throttling means interposed between said source of pressure fluid and said fluid actuator.

16. A load responsive system as set forth in claim 1 wherein said flow control means of said load responsive system include a second throttling means interposed between said fluid actuator and said exhaust means.

17. A load responsive system as set forth in claim 1 wherein said flow control means of said load responsive system includes first throttling means interposed between said source of pressure fluid and said fluid actuator and a second throttling means interposed between said fluid actuator and said exhaust means.

18. A load responsive system as set forth in claim 1 wherein said control force generating means of said first valve means and said positioning means of said second valve means include fluid power force generating means responsive to said first and said second control signal.

19. A load responsive system as set forth in claim 1 wherein said control force generating means of said first valve means includes fluid power force input means and said positioning means of said second valve means includes electric power force generating means.

20. A load responsive system as set forth in claim 1 wherein said control force generating means of said first valve means includes electro-hydraulic force generating means responsive to electrical control signal and said positioning means of said second valve means includes electric power force generating means responsive to said electrical control signal.

21. A load responsive system as set forth in claim 1 wherein said flow control means of said load responsive system include first throttling means interposed between said source of pressure fluid and said fluid actuator and a fluid power amplifying means operable to control said first throttling means.

22. A load responsive system as set forth in claim 1 wherein flow control means of said load responsive system include second throttling means interposed between said fluid actuator and said exhaust mneans and a fluid power amplifying means operable to control said second throttling means.

23. A load responsive system as set forth in claim 1 wherein said flow control means of said load responsive system include first throttling means interposed between said source of pressure fluid and said fluid actuator and second throttling means interposed between said fluid actutor and said exhaust means and a fluid power amplifying means operable to control said first and said second throttling means.

24. In a load responsive system including a fluid power actuator operable to control a positive or negative load, a source of pressure fluid, fluid exhaust means, flow control means of said load responsive system and first valve means for selectively interconnecting said actuator with said source of pressure fluid and said fluid exhaust means and to direct the flow of fluid subjected to positive type and negative type load pressure, first and second control force generating means responsive to a first and second control signal and operable to control the position of said first valve means, second valve means including positioning means responsive to said first and said second control signals and means to identify the type of load pressure having positive and negative load pressure identifying means, transmitting means operable to conduct said positive and said negative load pressure to positive and negative load pressure throttling controls of said flow control means of said load responsive system and first and second blocking means operable to isolate said positive load pressure and said negative load pressure from said transmitting means in the absence of said first and said second control signals.

25. A load responsive system as set forth in claim 24 wherein said positive and negative load pressure throttling controls include fluid power amplifying means.

26. In a load responsive system including a fluid power actuator operable to control a positive or negative load, a source of pressure fluid, fluid exhaust means, flow control means of said load responsive system and first valve means for selectively interconnecting said actuator with said source of pressure fluid and said fluid exhaust means and to direct the flow of fluid subjected to positive type and negative type load pressure, control means operable to control position of said first valve means having means responsive to an electrical control signal, second valve means including positioning means responsive to said electrical control signal and means to identify the type of load pressure having positive and negative load pressure identifying means, transmitting means operable to conduct said positive and said negative load pressure to positive and negative load pressure throttling controls of said flow control means of said load responsive system and first and second blocking means operable to isolate said positive load pressure and said negative load pressure from said transmitting means in the absence of said electrical control signal.

27. In a load responsive system including a fluid power actuator operable to control a positive or negative load, a source of pressure fluid, fluid exhaust means, flow control means of said load responsive system and first valve means for selectively interconnecting said actuator with said source of pressure fluid and said fluid exhaust means and to direct the flow of fluid subjected to positive type and negative type load pressure, control means operable to control the position of said first valve means having means responsive to a manual input signal, means operable to generate fluid pressure signal having means responsive to the position of said first valve means, second valve means including positioning means having means responsive to said fluid pressure signal and means to identify the type of load pressure having positive and negative load pressure identifying means, transmitting means operable to conduct said positive and said negative load pressure to positive and negative load pressure throttling controls of said fluid control means of said load responsive system and first and second blocking means operable to isolate said positive load pressure and said negative load pressure from said transmitting means in the absence of said fluid pressure signal.

28. In a load responsive system including a fluid power actuator operable to control a positive or negative load, a source of pressure fluid, fluid exhaust means, flow control means of said load responsive system and first valve means for selectively interconnecting said actuator with said source of pressure fluid and said fluid exhaust means and to direct the flow of fluid subjected to positive type and negative type load pressure, manual force control means operable to control the position of said first valve means above a certain predetermined force level, means operable to generate an control signal having means responsive to said manual force below said certain predetermine force level, second valve means including positioning means having means responsive to said control signal and means to identify the type of load pressure having positive and negative load pressure identifying means, transmitting means operable to conduct said positive and said negative load pressure to positive and negative load pressure throttling controls of said load responsive system and first and second said blocking means operable to isolate said positive load pressure and said negative load pressure from said transmitting means in the absence of said control signal.

* * * * *